United States Patent [19]

Matsumoto

[11] Patent Number: 5,058,540

[45] Date of Patent: Oct. 22, 1991

[54] ENGINE VALVE DRIVING DEVICE

[76] Inventor: Takuya Matsumoto, 228, Kuroda 2-chome, Kanazawa-shi, Ishikawa-ken, Japan

[21] Appl. No.: 617,818

[22] Filed: Nov. 26, 1990

[30] Foreign Application Priority Data

Nov. 24, 1989 [JP] Japan ..... 1-305869

[51] Int. Cl.[5] ..... F01L 1/34; F01L 1/30

[52] U.S. Cl. ..... 123/90.17; 123/90.18; 123/90.26; 123/90.6

[58] Field of Search ..... 123/90.15, 90.16, 90.17, 123/90.18, 90.24, 90.26, 90.6

[56] References Cited

U.S. PATENT DOCUMENTS

| | | | |
|---|---|---|---|
| 1,937,152 | 11/1933 | Junk | 123/90.26 |
| 2,122,484 | 7/1938 | Murray | 123/90.26 |
| 4,061,115 | 12/1977 | Predhome, Jr. | 123/90.24 |
| 4,711,202 | 12/1987 | Baker | 123/90.26 |
| 4,887,565 | 12/1989 | Bothwell | 123/90.26 |

FOREIGN PATENT DOCUMENTS

| | | | |
|---|---|---|---|
| 0129109 | 6/1988 | Japan | 123/90.6 |
| 434247 | 8/1935 | United Kingdom | 123/90.26 |
| 516746 | 1/1940 | United Kingdom | 123/90.26 |

OTHER PUBLICATIONS

Japanese Public Disclosure No. 1-253513 (Appln No. 63-81735) Laid Open 10/9/89.

*Primary Examiner*—Willis R. Wolfe
*Assistant Examiner*—Weilun Lo
*Attorney, Agent, or Firm*—Jones, Tullar & Cooper

[57] ABSTRACT

An engine valve driving mechanism includes a cam having a tubular wall rotatable about a horizontal axis. A cam follower contacts both the inner and outer surfaces of the tubular cam wall, so that the follower is positively driven toward and away from the axis of rotation of the cam. The follower is connected to a valve stem mounted for motion in a direction perpendicular to the axis of rotation of the cam so that the motion of the cam follower enables the cam to positively and accurately drive the valve. The peripheral wall may be differently shaped in cross-section at different axial locations to provide different patterns of valve stem motion, and the cam is movable along its axis of rotation to permit selection of a desired pattern.

8 Claims, 2 Drawing Sheets

ENGINE VALVE DRIVING DEVICE

BACKGROUND OF THE INVENTION

The present invention relates, in general, to a valve driving device, and more particularly to a tubular cam which is used to drive a follower connected to a valve such as the intake valve or the exhaust valve of a four-cycle engine.

As is well known in the prior art, engine valves are conventionally driven by a cam shaft through a rocker arm assembly, with valve springs surrounding the valve stems to drive the valves to their closed position. The tips of the air intake and exhaust valve stems are contacted by corresponding pivoting rocker arms so that the valves are driven open by the movement of the rocker arms, and are returned to their closed position by their corresponding valve springs. When engines utilizing such a construction are operated at high speed, however, the valve timing is often adversely affected so that the valve closing is delayed and the valve remains open at times in the cycle when it should be closed. This is caused by the fact that the spring cannot operate quickly enough to close the valve, and at very high speeds this sometimes results in valve flotation.

One correction for the foregoing problem is the provision of a stronger spring. However, when such a spring is used, it becomes necessary to use considerable force to open the valve, and this pressure on the spring produces tremendous friction on the various contacting parts, which produces additional problems.

SUMMARY OF THE INVENTION

It is an object of the present invention to solve the aforementioned problems by the provision of a valve driving device which achieves a positive closing and opening of the valve by the direct operation of a cam on the valve stem.

Briefly, the present invention relates to an engine valve driving mechanism which is characterized by a tubular cam rotatable about an axis and a cam follower which contacts both the inner and outer surface of the tubular cam so that it is positively driven both toward and away from the axis of rotation. The follower is connected to a valve stem so that the motion of the cam follower is transferred to the valve through a positive connection which enables the cam to accurately drive the valve even at high engine speeds.

In a preferred form of the invention, the follower is in the form of a pair of opposed rollers which provide rolling contact with the inner and outer surfaces of the tubular cam, and these rollers provide what may be referred to as a pivoting ball contact with the cam. The tubular cam is mounted on a shaft for rotation and the shaft is mounted for horizontal axial motion toward and away from the cam follower, and thus is horizontally adjustable with respect to a vertically movable valve stem. The cam follower, or pivoting ball assembly, is in close proximity to the inner and outer surfaces of the cam so that it follows the peripheral shape of the wall of the cam as the cam rotates about the longitudinal axis of the cam shaft.

The tubular cam has a peripheral shape which controls the motion of the follower, and thus of the valve, so that the valve opens and closes in a selected pattern as the cam shaft rotates. This peripheral shape varies along the axis of the cam, so that the motion of the valve depends on the axial position of the cam shaft with respect to the follower. Thus, for example, the tubular cam may be shaped at one end of the tube (for example, the inner end) to drive the valve for low engine speed and may be shaped at its opposite end (for example, the outer end) to drive the valve for high engine speed operation. Thus, by causing the cam to advance or retreat along its axis, the valve operation can be varied to meet the different timing needs for high speed operation and for low speed operation. Furthermore, the shape of the cam is tapered from one end to the other so as to provide a smooth transition from the high to the low speed contact surfaces of the cam to provide correct valve timing to intermediate speeds, as well. At the extremities of the horizontal motion, the periphery of the cam can be circular and concentric with its axis of rotation to provide continuous open or closed positions for the valve.

In operation of the device of the present invention, the peripheral wall of the tubular cam is shaped to produce a desired range of motion of the valve which is to be driven. The cam is rotated about its axis and the pivoting ball contact which is secured to the valve stem is moved upwardly and downwardly, toward and away from the axis of rotation of the cam, as the cam shaft rotates to carry out the desired opening and closing operation of the valve. Since the cam follower is directly linked to the valve stem, and since it makes a positive contact with the tubular cam, the opening and closing operation of the valve is directly linked to the rotation of the cam shaft, and timing is easily obtained. Furthermore, by longitudinal motion of the cam along its axis of rotation, and thus toward or away from the valve stem, different axial locations of the cam surface are brought into contact with the cam follower, and since these different axial locations have different shapes, the motion of the valve stem, and thus the timing of the opening and closing of the valve is varied. This arrangement permits a continuous variation of the valve timing from low engine speed to high engine speed so that power is generated with optimal effect at any selected engine speed. Furthermore, since the cam for each valve can be individually shaped or can be individually moved in the horizontal direction, a wide range of engine control is possible. Thus, for example, it is possible to shape the cams so that one part of the engine is brought to a stop by positioning the cam follower at a circular concentric portion of the cam so that the valve remains either open or closed. Furthermore, it is also possible to use the valve in a variable compression ratio engine.

The valve structure of the present invention provides significant advantages over the prior spring-operated valves, the present invention being characterized by low frictional losses, simplicity of operation, and optimizing of engine performance.

BRIEF DESCRIPTION OF THE DRAWINGS

The foregoing, and additional objects, features, and advantages of the invention will be better understood from the following detailed description of preferred embodiments thereof, taken in conjunction with the accompanying drawings, in which.

DESCRIPTION OF THE PREFERRED EMBODIMENTS

Figure 1:
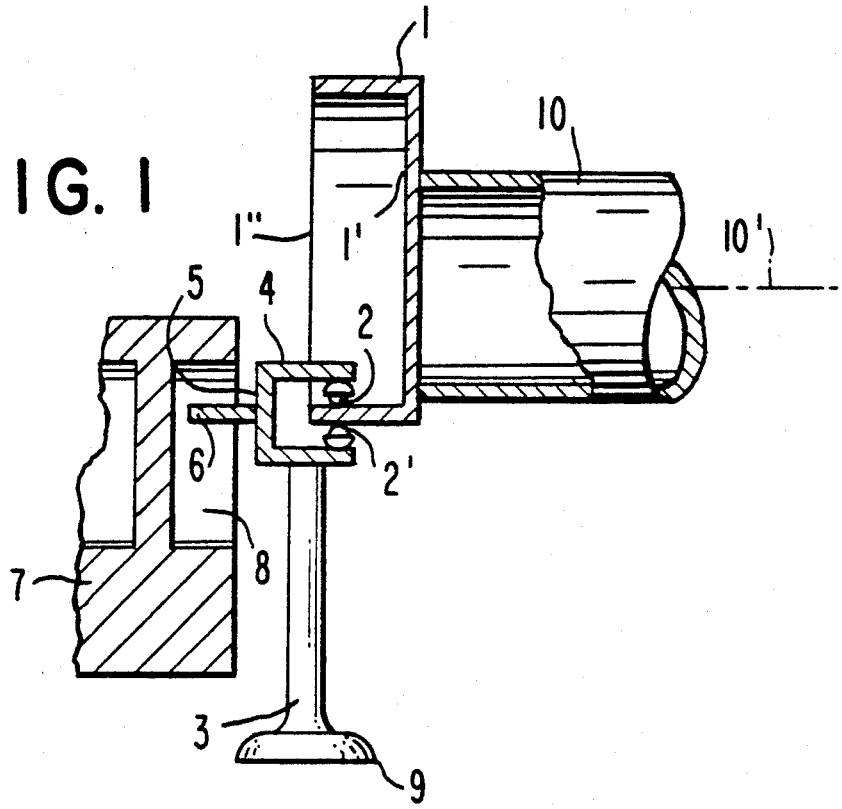
FIG. 1 is a side elevation view, in partial section, of an engine valve driving mechanism in accordance with the present invention.

Turning now to a more detailed description of the present invention, there is illustrated in FIG. 1 an engine valve driving cam arrangement in accordance with the present invention. As illustrated, a tubular cam 1 has a closed inner end 1' and an open outer end 1" and is generally cup-shaped. Engaging the outer peripheral wall of the cam is a sliding ball contact. element which carries a pair of opposed cam follower balls 2 and 2", the first contacting the inner surface of the wall of cam 1, and the other contacting the outer surface of the cam wall. The sliding ball element is mounted on the top surface of a valve stem 3 for motion therewith, and includes a bracket 4 having upper and lower arms which hold the balls 2 and 2" in proximity to the inner and outer surfaces, respectively, of the cam wall.

As illustrated, the bracket 4 may be generally U-shaped and mounted in a direction facing the cam so that the upper leg of the bracket extends into the cup-shaped cam and the lower leg of the bracket, as viewed in FIG. 1, extends along the outside of the cam. The upper and lower legs carry suitable sockets for supporting the contact balls 2 and 2", respectively, in contact with the inner and outer surfaces of the cam wall. The base of the bracket consists of a plate 5 which carries a guide rod 6 which extends outwardly from the bracket in a direction generally perpendicular to the valve stem. The guide rod is linked to the cylinder head 7 of the engine in which the valve to be controlled is located, and preferably moves vertically within a groove 8 formed in the cylinder head 7 to guide and stabilize the motion of the valve stem 3.

Valve 9 is located at the bottom of stem 3 and engages a suitable valve seat (not shown) in the cylinder head 7 in conventional manner. The cam 1 is mounted on a rotatable cam shaft 10 which is located to rotate the cam 1 about an axis 10' which is perpendicular to the direction of motion of valve stem 3.

As illustrated in FIG. 1, the side wall of cam 1 is tubular, with its axis offset from the axis of rotation 10'. As the cam shaft 10 rotates, the distance between the wall of the cam 1 and the axis 10' varies with the rotational position of the cam, whereby rotation of the cam shaft causes the cam follower balls 2, 2' to drive the bracket 4 upwardly toward the axis 10' or downwardly away from the axis 10', thereby reciprocating the valve stem 3 and the valve 9 in accordance with the rotation of the cam shaft.

Figure 2:
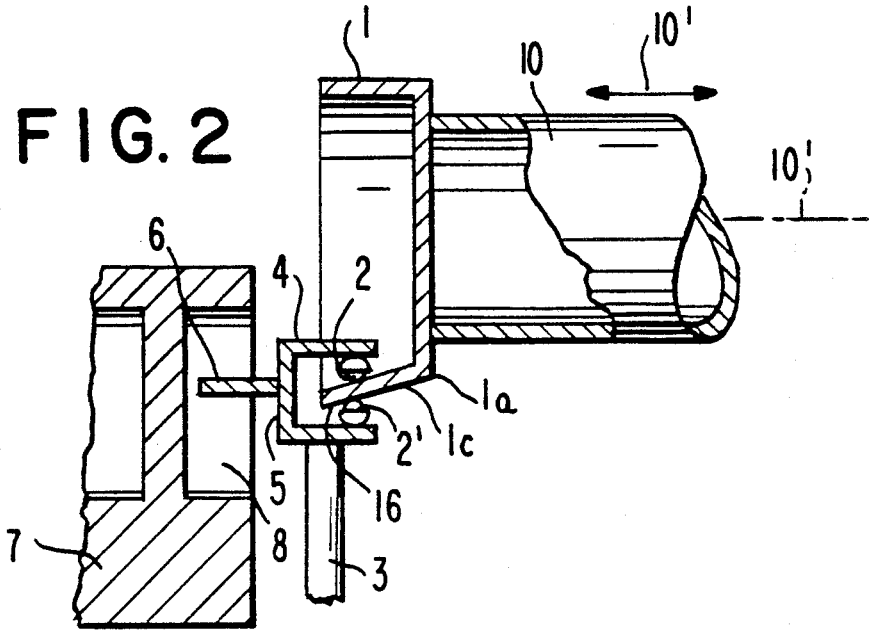
FIG. 2 is a side elevational view, in partial section, illustrating a tubular cam shaped differently from that of FIG. 1.
Figure 3:
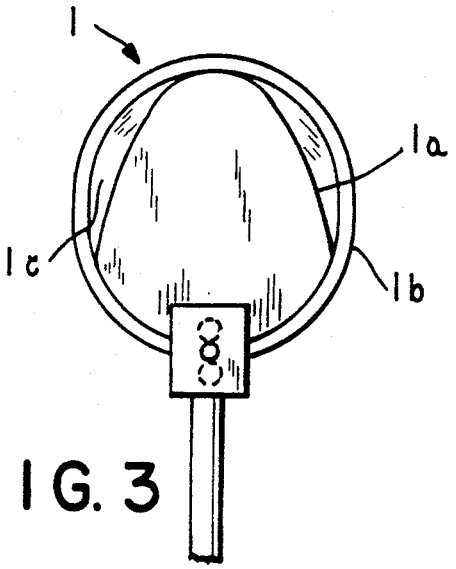
FIG. 3 is a partial front elevation view of the device of FIG. 2, taken from the left-hand end of FIG. 2.
Figure 4:
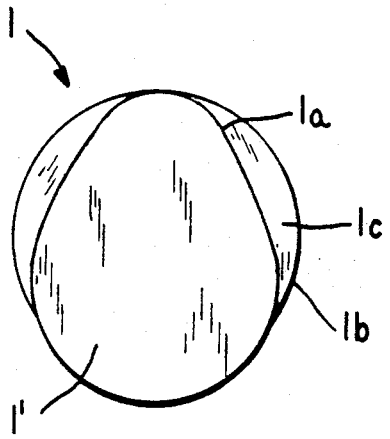
FIG. 4 is a partial back view of the device of FIG. 2 as viewed from the right-hand end of FIG. 2.

In a preferred form of the invention, as illustrated in FIG. 2, the peripheral side wall of the cam is generally tubular, but is generally egg-shaped at its innermost end 1*a* to provide a cam shape which is suitable for low speed engine operation, and is shaped with an outward swelling, illustrated at 1*b* in FIGS. 3 and 4, to provide a cam shape at its outermost end 1" which is suitable for high-speed rotational operation of an engine. The transition region 1*c* between the egg-shape 1*a* and the high-speed shape 1*b* is tapered so as to provide a smooth transition between the shape of the cam contact cam surface 1*a* and its shape at cam contact surface 1*b*. This taper permits a smooth, continuous transition from the low-speed rotational area to the high-speed rotational area. Further, the taper can be selected to provide a different cam shape for each axial position of the cam from its innermost end 1' to its outermost end 1" so that the pattern of vertical motion of the valve stem 3 upon rotation of the cam 1 can be made to depend upon the specific axial location of cam 1 with respect to the contact balls 2, 2'. As indicated by the arrow 10' in FIG. 2, the cam shaft 10 preferably is mounted to permit forward and reverse movements in a horizontal direction along the axis 10' so that the position of cam 1 can be axially varied with respect to valve stem 3.

As a result of the above-described construction, when the cam shaft 10 is moved in forward or reverse directions, toward or away from the valve stem 3, the cam will contact the ball elements 2 and 2' at different axial locations so that a desired cam shape can be selected in accordance with the speed of operation of the engine in which the valve is located. Thus, it is possible to regulate the output power of the engine through changing of the valve timing by means of a stepless variable cam and valve drive mechanism.

Figure 5:
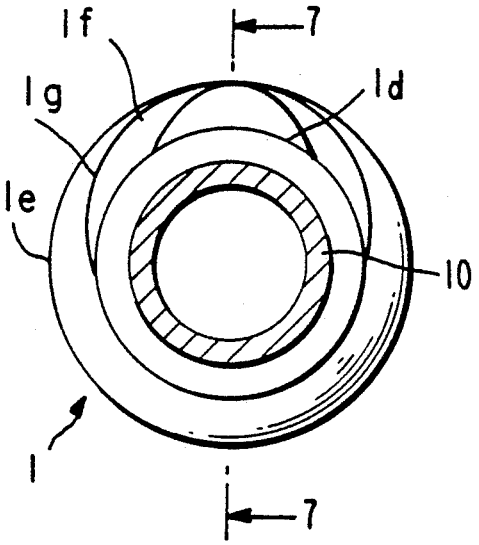
FIG. 5 is a back view of a modified form of the cam used in the device of FIG. 2.
Figure 6:
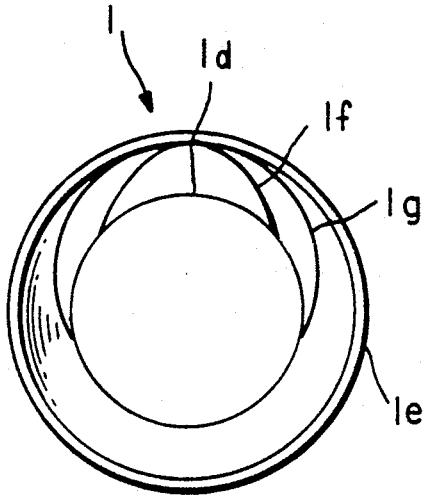
FIG. 6 is a front view of the cam of FIG. 5.
Figure 7:
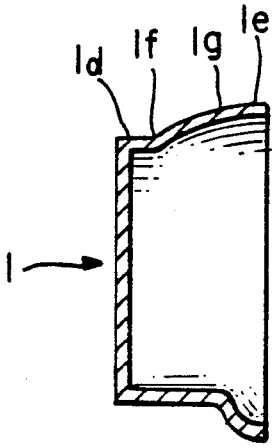
FIG. 7 is a vertical cross sectional view taken along line 7—7 of FIG. 5.

The shape of the cam 1 can be varied as desired to provide a wide range of timing controls for a valve. FIGS. 5 to 7 illustrate an alternative cam structure which further exemplifies the wide range of possible variations in cam shapes. In these figures, the outer end 1" of the cam forms a large circular region 1*e*, while the end 1' forms a small circular region 1*d*, with both of these regions being concentric with the axis of rotation of the cam shaft 10. The circular region 1*d* is sufficiently small to hold the valve 9 in a closed position, while the circular region 1*e* is sufficiently large to hold the valve 9 in a continuously open position. The cam is shaped at intermediate positions between the axial locations 1*d* and 1*e* to provide, for example, a low-speed rotation shape 1*f* which is generally egg-shaped in the manner illustrated in FIG. 3, and a high-speed shaped region 1*g*, similar to that illustrated in FIG. 3 at 1*b*, to provide high-speed rotation for the engine, with a continuously tapered surface extending between all of the axial regions of the cam, generally as illustrated in FIG. 7. With the cam shaft 10 movable in forward and reverse directions as described with respect to FIG. 2, various axial locations of the cam surface can be brought into contact with the sliding ball elements 2, 2' to provide a selected motion of the valve with respect to the cam axis in accordance with the rotational motion of the cam.

Since the present invention utilizes a tubular cam with a direct connection to a valve stem by way of a sliding ball connector element, there is no delay in the motion of the valve with respect to the rotational position of the cam shaft 10 so that closure of the valve can be easily effected during high speed rotation of the engine. This provides a significant advantage of the valve spring arrangement, since it reduces the resistance and simplifies the operation of the device while providing optimal performance for the engine. The shape of the cam permits a wide range of timing control for the valve by axial motion of the cam toward and away from the valve stem, with the valve being secured for vertical motion by the sliding ball element linkage to the surrounding engine structure such as the cylinder head. This arrangement also permits stoppage of selected parts of the engine, as by positioning the corresponding cam to hold selected intake or exhaust valves in their continuously open or closed positions and thus provides a very wide range of operational control.

Although the present invention has been described in terms of preferred embodiments, it will be understood that variations and modifications may be made without departing from the true spirit and scope thereof as set forth in the accompanying claims.

What is claimed is:

1. An engine valve driving device, comprising:

a tubular cam means rotatable about a horizontal axis, said cam means incorporating a peripheral wall surrounding said axis; and a pivoting ball assembly mounted on a valve stem for vertical motion therewith, said assembly including contact means engaging inner and outer surfaces of the peripheral wall of said cam means said peripheral wall is generally tubular and has an inner end and an outer end along said axis, and wherein the inner and outer ends of said wall are shaped to produce different patterns of motion in said valve stem, whereby said valve stem is driven by rotation of said cam means.

2. The device of claim 1, wherein one end of said peripheral wall is shaped to produce a pattern of motion suitable for high speed operation of an engine in which the valve is mounted, and wherein the other end of said peripheral wall is shaped to produce a pattern of motion suitable for low speed operation of an engine in which the valve is mounted.

3. The device of claim 1, wherein said peripheral wall has a transition region between said one and said other ends, and wherein said transition region of said wall is tapered to provide a continuous, smooth contact surface for said contact means from one end of said peripheral wall to the other.

4. The device of claim 1, wherein at least one portion of said peripheral wall is concentric with the axis of rotation of said cam means.

5. The device of claim 4, wherein said peripheral wall is concentric with said axis of rotation at both said inner and outer ends to prevent motion of said valve during rotation of said cam, and wherein said peripheral wall is shaped between its ends to produce motion in said valve.

6. The device of claim 1, further including means for shifting said cam along said horizontal axis.

7. The device of claim 1, wherein said peripheral wall extends along said horizontal axis, said wall having a shape defined by its radial distances from said horizontal axis at different axial locations, the shape of said wall being selected to produce predetermined corresponding motions in said valve stem.

8. The device of claim 7, further including means for shifting said cam along said horizontal axis to cause said contact means to engage said peripheral wall at a selected axial location, to thereby produce a pattern of motion in said valve stem corresponding to the shape of said wall at the selected location.

* * * * *